US005229780A

United States Patent [19]

Hirotsu et al.

[11] Patent Number: 5,229,780

[45] Date of Patent: Jul. 20, 1993

[54] WIDE-BAND ANTENNA ON VEHICLE REAR WINDOW GLASS

[75] Inventors: Tohru Hirotsu; Kazuhiko Fujii, both of Matsusaka, Japan

[73] Assignee: Central Glass Company, Limited, Yamaguchi, Japan

[21] Appl. No.: 724,210

[22] Filed: Jul. 1, 1991

[30] Foreign Application Priority Data

Jun. 29, 1990 [JP] Japan ..... 2-172227
Jul. 30, 1990 [JP] Japan ..... 2-202290
Aug. 27, 1990 [JP] Japan ..... 2-225950

[51] Int. Cl.[5] ..... H01Q 1/32
[52] U.S. Cl. ..... 343/713
[58] Field of Search ..... 343/704, 711, 712, 713; 219/203

[56] References Cited

U.S. PATENT DOCUMENTS 4,439,771 3/1984 Kume et al. ..... 343/743
4,608,570 8/1986 Inaba et al. ..... 343/713
4,954,797 9/1990 Shinnai et al. ..... 343/713
5,029,308 7/1991 Lindenmeier et al. ..... 343/743

FOREIGN PATENT DOCUMENTS 0138903 10/1980 Japan ..... 343/713
61-121603 6/1986 Japan .
61-203702 9/1986 Japan .
0038001 2/1987 Japan ..... 343/713

*Primary Examiner*—Rolf Hille
*Assistant Examiner*—Tan Ho
*Attorney, Agent, or Firm*—Keck, Mahin & Cate

[57] ABSTRACT

The invention relates to an antenna on a vehicle rear window glass for the reception of FM radio broadcasting and TV broadcasting in both the VHF and UHF bands. The window glass is provided with defogging heater strips, and the antenna uses a space left above the heater strips. The antenna is constructed of a plurality of linear elements comprising (A) a combination of two primary elements, which are spaced from each other in the direction widthwise of the window glass and each of which makes the perimeter of a horizontally elongate rectangle or two horizontal sides and one vertical side of the rectangle, and a connection line which connects the two primary elements to each other and (B) a secondary element having a first part which extends from one of the two primary elements or the connection line to a point between the combination (A) and the upper edge of the window glass and a second part which extends horizontally from said point toward a side edge of the window glass and is connected to a feed point located near the side edge of the window glass. Optionally a supplementary element or supplementary elements may be connected to the combination (A) and/or the secondary element (B).

34 Claims, 10 Drawing Sheets

WIDE-BAND ANTENNA ON VEHICLE REAR WINDOW GLASS

BACKGROUND OF THE INVENTION

This invention relates to an antenna provided to a vehicle rear window glass for receiving FM radio and television (TV) broadcast waves, the antenna being constructed of conductive strips attached to the window glass by using a space above defogging heater strips. The antenna is particularly suited to automobiles.

In recent automobiles there is a trend to the adoption of a so-called window glass antenna for receiving radio broadcast waves, and there is an increasing demand for a window glass antenna which can efficiently receive both FM radio broadcast waves and TV broadcast waves. To meet such a demand there are several proposals.

For example, JP 61-203702 A proposes a windshield antenna having, as an essential element, a conductive strip which extends vertically in the central region of the windshield, and JP 61-121603 A proposes a rear window glass antenna which is arranged in a space left above an array of defogging heater strips and includes two feed points which are connected to two different points of an antenna element, respectively.

However, in the case of providing an antenna in a central region of the windshield the driver's field of view is inevitably obstructed.

In the case of providing an antenna to an automobile rear window glass which needs to be provided with defogging heater strips, the antenna must be arranged in a relatively narrow space contiguous to an edge of the window glass since a central region is occupied by the heater strips. That is, the antenna nears the metal body of the car which is regarded as the ground. By reason that the allowed space is narrow and off-centered it is difficult to construct an antenna which exhibits high reception gain over a wide range of frequency including the FM radio broadcasting bands and both the VHF and UHF bands for TV broadcasting.

SUMMARY OF THE INVENTION

Concerning a vehicle rear window glass, in particular an automobile rear window glass, which is provided with a set of defogging heater strips, it is an object of the present invention to provide a window glass antenna which can be arranged by utilizing a relatively narrow space between the defogging heater strips and the upper edge of the window glass and can receive FM radio broadcast waves and TV broadcast waves in both the VHF band and the UHF band with sufficiently high gain.

We have succeeded in constructing an excellent wide-band antenna for the reception of FM and TV broadcasting in the space above the defogging heater strips on a vehicle rear window glass fundamentally by using, as the main antenna elements, two elements each of which is a linear element bent so as to make the perimeter of a horizontally elongate rectangle or the two horizontal sides and one vertical side of the rectangle, placing these two elements in a horizontally spaced arrangement and electrically connecting the two elements with each other. Further, we have completed the present invention by combining the aforementioned two main elements with a secondary element which is a linear element bent so as to have a part extending generally upward from one of the two main elements or the connection line between-the two main elements and a horizontal part which extends toward a side edge of the window glass and is connected to a feed point located near the side edge of the window glass. The secondary element serves the purpose of improving the directional characteristics of the antenna and/or adjusting the impedance of the antenna and consequently has the effect of enhancing the reception gains of the antenna.

The present invention provides an antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in that space and comprising a combination of two primary elements and a connection line, a secondary element and a feed point. The two primary elements are spaced from each other in the direction widthwise of the window glass, and each of these two elements is a linear element bent so as to make the perimeter of a horizontally elongate rectangle or the two horizontal sides and one vertical side of the rectangle. The connection line comprises a horizontal part and connects the two primary elements to each other. The secondary element is a linear element bent so as to have a first part which extends from one of the two primary elements or the connection line between the two primary elements to a point between the combination of the two primary elements and the upper edge of the window glass and a second part which extends horizontally from the aforementioned point toward a side edge of the window glass. At least a lower end portion of the first part of the secondary element is a vertical part extending toward the aforementioned point. Within the space above the heater strips the feed point is located in a marginal region contiguous to the aforementioned side edge, and the second part of the secondary element is connected to the feed point.

In this specification the term "vertical" is used in the sense of "perpendicular to horizontal lines on the window glass". That is, a "vertical" part of any antenna element is not always literally vertical when the window glass is attached to the vehicle body.

As to the two primary elements of an antenna according to the invention it is possible to employ any of the following three combinations: combination of two completely rectangular elements; combination of two elements in the shape of an incomplete rectangle devoid of one vertical side; and combination of one completely rectangular element and one incompletely rectangular element. Usually one of the two primary elements is positioned between the vertical center axis of the window glass and a side edge of the glass and the other between the center axis and the opposite side edge of the window glass, but there is a case where one of the two elements intersects the center axis.

As to the secondary part, the aforementioned first part may be either entirely straight and vertical or bent so as to extend from one of the two primary elements or the connection line between the two elements first vertically upward, then horizontally toward a side edge of the window glass opposite to the side edge near the feed point, then upward and then horizontally toward the point from which the second part extends horizontally. For enhancing the reception gains of the antenna it is rather preferable to bend the first part in the above manner.

The essential elements of an antenna according to the invention are as stated above, and in many cases it is not necessary to add any extra element for the reception of both FM radio broadcast waves and TV broadcast waves. However, it is optional to incorporate a supplementary element or a plurality of supplementary elements for the purpose of adjusting the impedance of the antenna, improving the directional characteristics of the antenna and/or making capacitive coupling of the antenna with the defogging heater strips. It is possible to connect a supplementary element to any of the two primary elements, the connection line between the two primary elements and the secondary element, and each supplementary element may be either straight or bent at right angles.

A vehicle window glass antenna according to the invention can be constructed in a relatively narrow area left above the defogging heater strips, and this antenna serves as a wide-band antenna which can receive FM radio broadcast waves in a 76–108 MHz band, which includes the FM radio broadcasting band used mainly in Japan and the FM radio broadcasting band used in many other countries including the United States and Canada, and TV broadcast waves in both the VHF band (90–108 MHz and 170–222 MHz) and the UHF band (470–770 MHz) with satisfactory high reception gains. The invention is very suitable for application to automobiles.

DESCRIPTION OF THE PREFERRED EMBODIMENTS

Figure 1:
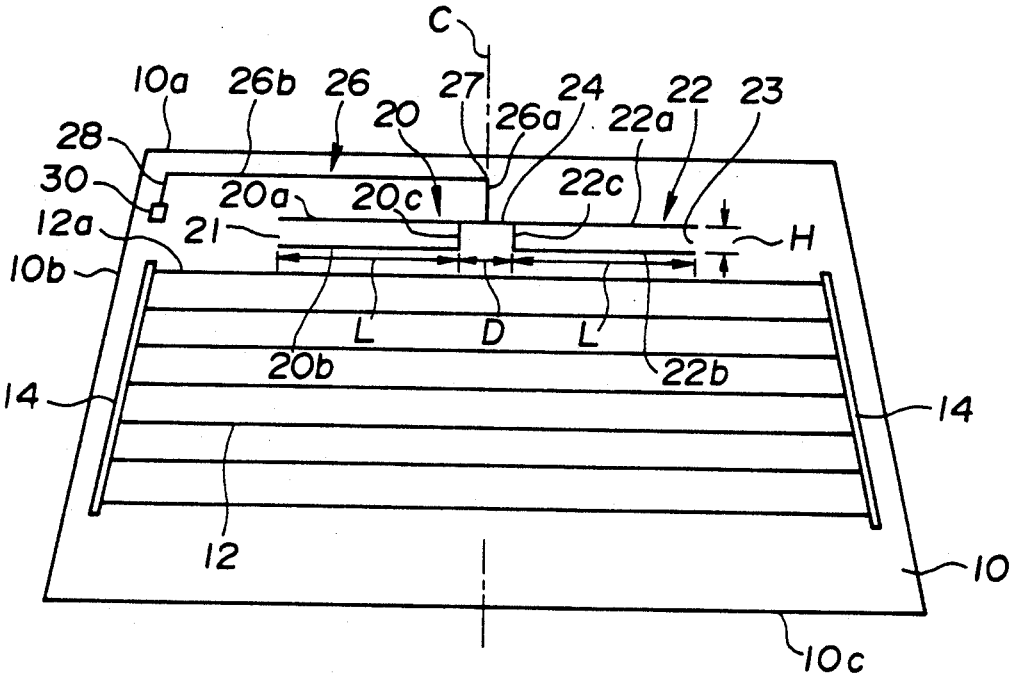
FIG. 1 is a plan view of an automobile rear window glass provided with an antenna according to the invention in a space above defogging heater strips.

FIG. 1 shows an automobile rear window glass in which the present invention is embodied. A single piece of glass plate 10 is used as the window glass. A set of defogging heater strips 12 is disposed on the inboard surface of the window glass 10 so as to leave an open space between the upper edge 10*a* of the glass and the uppermost heater strip 12*a*. The heater strips 12 extend horizontally and connect with a pair of bus bars 14.

Using the space above the heater strips 12 an antenna according to the invention is disposed on the inboard surface of the window glass 10. Essentially the antenna is a combination of a pair of primary elements 20 and 22 and a secondary element 26, and every element of the antenna is a linear element made of a thin, conductive strip.

The two primary elements 20 and 22 are arranged symmetrically with respect to the vertical center axis C of the window glass 10, and each of these two elements 20, 22 is bent so as to make three sides of a rectangle which is horizontally elongate. That is, the element 20 on the left-hand side has two horizontal parts 20*a* and 20*b* which are parallel and have the same length and a relatively short vertical part 20*c* which connects an end of the horizontal part 20*a* to an end of the horizontal part 20*b* at a short distance from the center axis C. There is a gap 21 between the opposite end of the upper horizontal part 20*a* and the opposite end of the lower horizontal part 20*b*. Similarly the element 22 on the right-hand side has two horizontal parts 22*a*, 22*b* which are parallel and have the same length and a relatively short vertical part 22*c* which is at a short distance from the center axis C. There is a gap 23 between the two horizontal parts 22*a* and 22*b* at the right-hand ends thereof. The two elements 20 and 22 are connected to each other by a horizontal connection line 24 which is in alignment with the upper horizontal parts 20*a*, 22*a* of the respective elements.

The secondary element 26 has a relatively short vertical part 26*a*, which extends upward from a middle point of the connection line 24, and a horizontal part 26*b* which extends from the upper end 27 of the vertical part 26*a* toward the left-hand side edge 10*b* of the window glass 10. That is, the horizontal part 26*b* extends in a space above the primary element 20 from a point (27) between the combination of the two primary elements 20, 22 and the upper edge 10*a* of the window glass. There is a feed point 30 in an upper left corner region of the window glass 10, and the left-hand end of the horizontal part 26*b* of the secondary element 26 is connected to the feed point 30 by a relatively short connection line 28.

Usually the heater strips 12, bus bars 14, primary and secondary antenna elements 20, 22, 26, connection lines 24, 28 and the feed point 30 are formed by printing a conductive paste onto the glass surface and, after drying, baking the glass plate with the printed paste thereon. In the case of the rear window glass using laminated glass it is also possible to embed the antenna according to the invention in the laminated glass, and in that case it is optional to sandwich the antenna between two plastic interlayers by using a thin metal wire or foil as the material of the antenna elements.

In a sample of the window glass of FIG. 1 the glass plate 10 was 1150 mm in the length of the upper edge 10*a*, 1450 mm in the length of the lower edge 10*c* and 740 mm in the length perpendicular to the upper and lower edges 10*a*, 10*c*, and the dimensions of and relating to the antenna elements were as follows.

Each of the two primary elements 20, 22 was 300 mm in the horizontal length L and 30 mm in the vertical length H, and the lower part 20*b*, 22*b* of each element was at a vertical distance of 30 mm from the uppermost heater strip 12*a*. The length D of the horizontal connection line 24 was 100 mm. The vertical part 26*a* of the secondary element 26 was 60 mm long, and the horizontal part 26*b* was 560 mm long and at a vertical distance of 20 mm from the upper edge 10*a* of the glass.

With this sample, the gains of the antenna in receiving FM radio broadcast waves in the 76–108 MHz band, TV broadcast waves of Nos. 1 to 12 channels in the VHF band (90–108 MHz and 170–222 MHz) and TV broadcast waves in the UHF band (470–770 MHz) were measured with respect to horizontally polarized waves and compared with the gains of a standard dipole antenna. That is, for any frequency or channel the gain of the dipole antenna was taken as the basis, 0 dB, and the gain of the sample antenna was marked on this basis. As the result, the gain of the sample antenna was −16.6 dB on an average in the FM radio broadcasting band, −19.0 dB on an average in the VHF band and −17.9 dB on an average in the UHF band. Considering that a good example of conventional rear window glass antennas exhibited an average gain (vs. standard dipole antenna) of about −19 dB in the FM radio band, about −20 dB in the VHF band and about −19 dB in the UHF band, the rear window glass antenna of FIG. 1 is judged to be a better antenna for the reception of either FM radio broadcast waves or TV broadcast waves in the VHF and UHF bands. In particular, for the reception of FM radio broadcast waves the antenna of FIG. 1 is far better than conventional window glass antennas.

Figure 2:
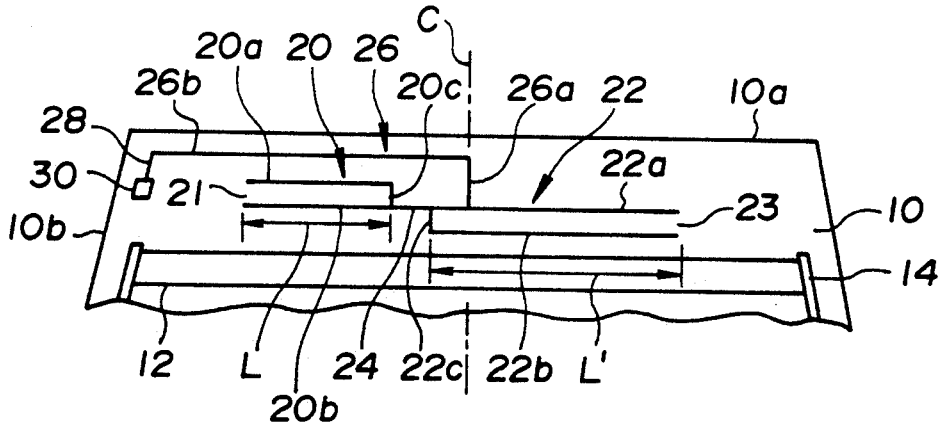
FIGS. 2 to 12 respectively show modifications of the antenna in FIG. 1 with respect to the primary elements of the antenna and/or supplementary elements.

FIG. 2 shows a modification of the antenna shown in FIG. 1 in respect of the arrangement of the two primary elements 20, 22. In the antenna of FIG. 2, the two primary elements 20 and 22 are different in horizontal length and in vertical distance from the upper edge 10*a* of the window glass. Furthermore, the element 22 on the right-hand side is arranged so as to cross the center axis C of the window glass 10, whereas the element 20 on the left-hand side does not intersect the center axis C. In this case the horizontal connection line 24 is in alignment with the lower horizontal part 20*b* of the element 20 and the upper horizontal part 22*a* of the element 22, and the vertical part 26*a* of the secondary element 26 extends from a point of the upper horizontal part 22*a* of the primary element 22 on the right-hand side.

In a sample of the window glass of FIG. 2, the window glass 10 and the antenna elements had the same dimensions as in the sample of the window glass of FIG. 1 except the following changes: the horizontal length L of the primary element 20 was 250 mm, and the horizontal length L′ of the element 22 was 400 mm. When this sample antenna was tested for the reception of FM radio broadcast waves and TV broadcast waves, average gains (vs. standard dipole antenna) of the sample antenna were −16.9 dB in the FM radio band (76–108 MHz), −18.2 dB in the VHH TV band and −17.9 dB in the UHF TV band. That is, the antenna of FIG. 2 is a good wide-band antenna comparable to the antenna of FIG. 1.

Figure 3:
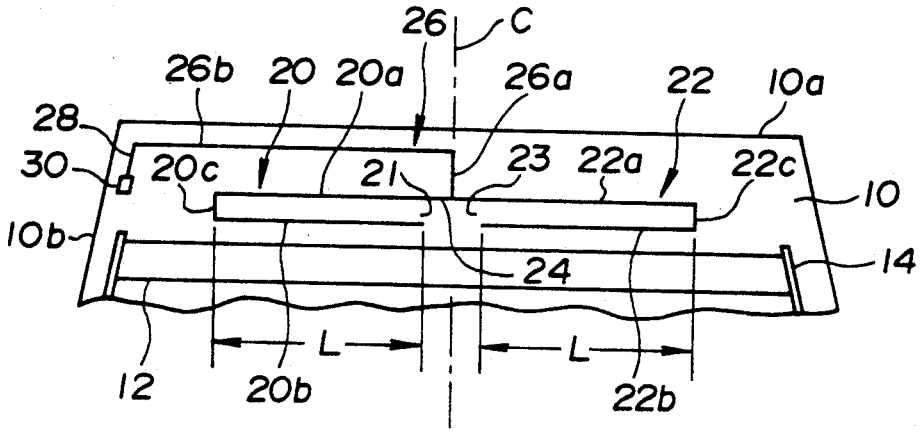

In FIG. 3, the antenna shown in FIG. 1 is modified only in respect of the position of the vertical part of each of the two primary elements 20 and 22. In this case the vertical part 20*c* of the element 20 on the left-hand side is at the left end of the element 20, and the vertical part 22*c* of the element on the opposite side is at the right end of the element 22. Therefore, the gap or open side 21 of the element 20 and the open side 23 of the element 22 are at short distances from the center axis C of the window glass.

In a sample of the antenna of FIG. 3 each of the two primary elements 20 and 22 was 350 mm in horizontal length L, and otherwise the dimensions of the antenna and the window glass were the same as in the sample of the antenna of FIG. 1. By the test described hereinbefore, average gains (vs. standard dipole antenna) of the sample antenna were −17.7 dB in the FM radio band −19.5 dB in the VHH TV band and −18.6 dB in the UHF TV band. That is, the antenna of FIG. 3 is nearly equivalent to the antenna of FIG. 1.

Figure 4:
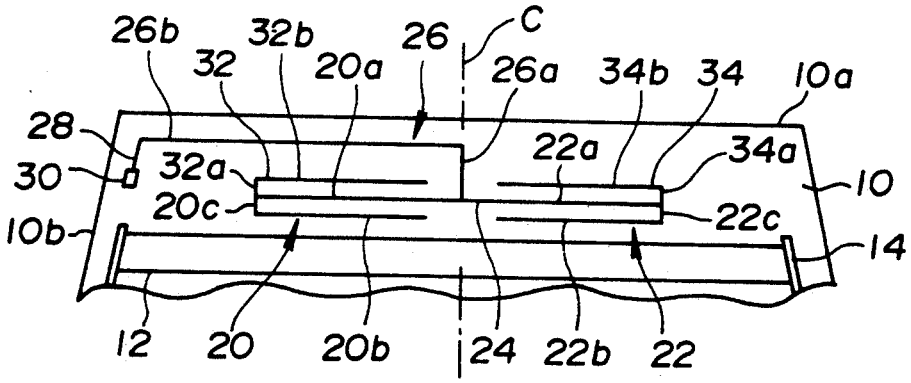

FIG. 4 shows the addition of two L-shaped supplementary antenna elements 32 and 34 to the antenna of FIG. 3. The supplementary element 32, which is directly connected to the primary element 20, has a relatively short vertical part 32*a*, which seems to be an upward extension of the vertical part 20*c* of the element 20, and a horizontal part 32*b* which extends above the element 20 toward the center axis C of the window glass. The supplementary element 34, which is directly connected to the primary element 22, has a relatively short vertical part 34*a*, which seems to be an upward extension of the vertical part 22*c* of the element 22, and a horizontal part 34*b* which extends above the element 22 toward the center axis C.

In a sample of the antenna of FIG. 4 each of the two supplementary elements 32 and 34 was 350 mm in horizontal length and 20 mm in vertical length, and each of the two primary elements 20 and 22 was 350 mm in horizontal length and 20 mm in vertical length. Otherwise the dimensions of the antenna and the window glass were the same as in the sample of the antenna of FIG. 1. By the test described hereinbefore, average gains (vs. standard dipole antenna) of the sample antenna were −17.1 dB in the FM radio band, −19.2 dB in the VHH TV band and −18.8 dB in the UHF TV band.

Figure 5:
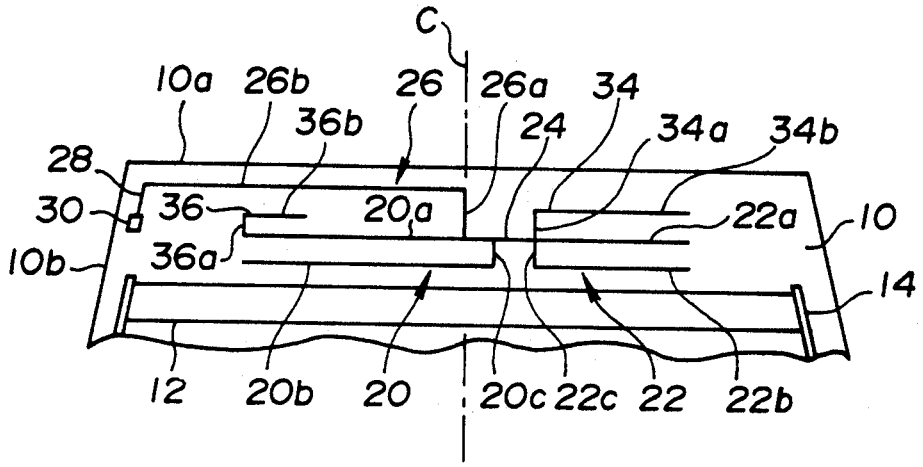

In FIG. 5 the antenna of FIG. 1 is modified in the following respects. The primary element 20 on the left-hand side is arranged so as to cross the center axis C of the window glass, whereas the element 22 on the right-hand side does not intersect the center axis C. The vertical part 26*a* of the secondary antenna 26 extends from the upper horizontal part 20*a* of the primary element 20. The L-shaped supplementary element 34 described with reference to FIG. 4 is connected to the primary element 22. Further, a relatively small, L-shaped supplementary element 36 is connected to the primary element 20. This element 36 has a short vertical part 36*a*, which extends upward from the free end of the upper horizontal part 20*a* of the element 20, and a horizontal part 36*b* which extends toward the center axis C.

Figure 6:
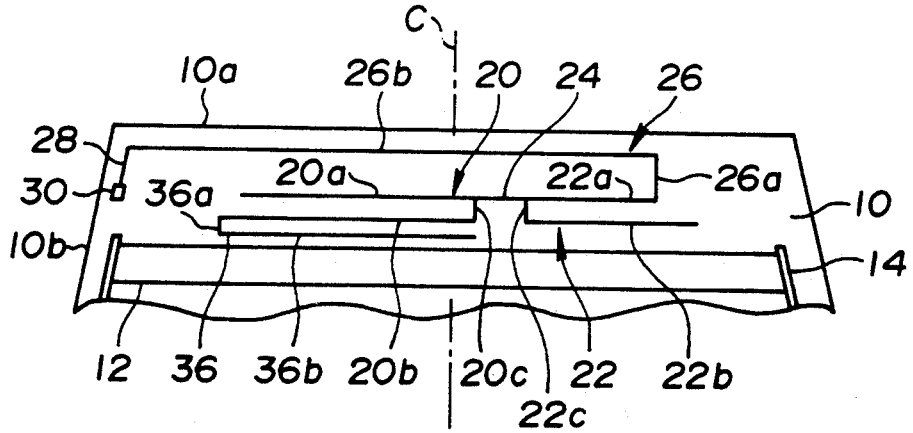

In FIG. 6 the antenna of FIG. 5 is modified in the following respects. In each of the two primary elements 20 and 22 the two horizontal parts are different in length. The vertical part 26*a* of the secondary element 26 extends from the right end of the upper horizontal part 22*a* of the primary element 22, and consequently the horizontal part 26*b* of the element 26 is lengthened. The supplementary element 34 was omitted, and the supplementary element 36 is connected to the lower horizontal part 20*b* of the primary element 20 such that the horizontal part 36*b* of the element 36 extends below the primary element 20.

The antennas of FIGS. 5 and 6 proved to be nearly equivalent to the antenna of FIG. 1 with respect to reception gains for FM radio and TV (VHF and UHF) broadcast waves.

Figure 7:
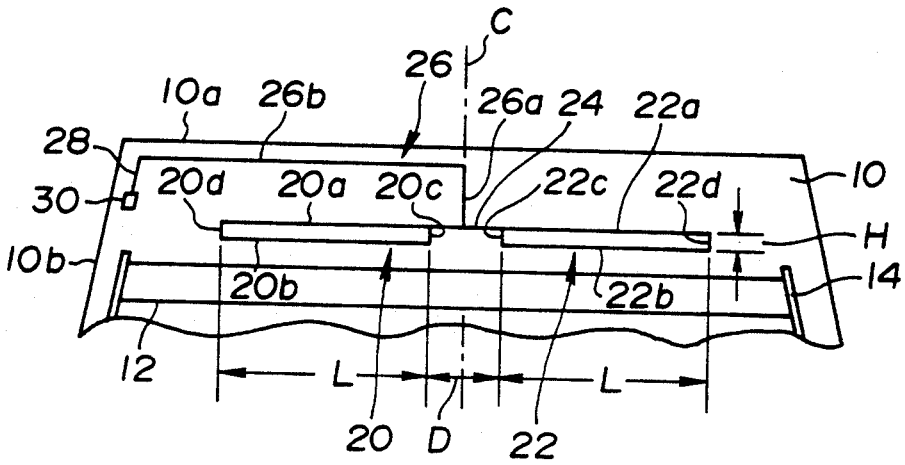

The antenna of FIG. 7 differs from the antenna of FIG. 1 in that each of the two primary elements 20 and 22 makes the perimeter of a complete rectangle. That is, in FIG. 7 the primary element 20 has another vertical part 20*d* which fills up the gap 21 in FIG. 1, and the primary element 22 on the opposite side has another vertical part 22*d* which fills up the gap 23 in FIG. 1.

In a sample of the antenna of FIG. 7 each of the two primary elements 20 and 22 was 350 mm in horizontal length L and 20 mm in vertical length H. Otherwise the dimensions of the antenna elements and the window glass were the same as in the sample of the antenna of FIG. 1. By the test described hereinbefore, average gains (vs. the dipole antenna) of this sample antenna were −17.3 dB in the FM radio band, −19.3 dB in the VHF TV band and −17.9 dB in the UHF TV band. That is, the antenna of FIG. 7 is nearly equivalent to the antenna of FIG. 1.

Figure 8:
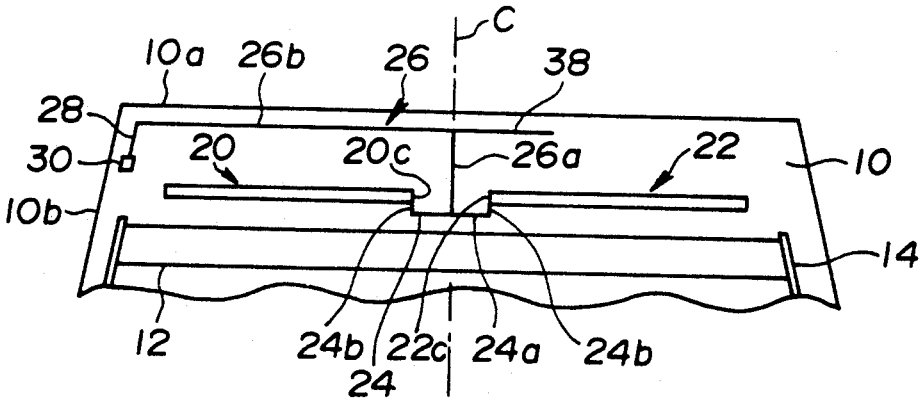

In FIG. 8, the antenna of FIG. 7 is modified by further elongating the rectangular shape of the primary elements 20, 22 and varying the position and shape of the connection line 24. Besides, this antenna includes a supplementary element 38, which is a horizontal element extending from the upper end of the vertical part 26a of the secondary element 26 in the direction reverse to the horizontal part 26b. The connection line 24 is located below the primary elements 20, 22 and bent so as to have two short vertical parts 24b which extend downward from the lower end of the vertical part 20c of the primary element 20 and the lower end of the vertical part 22c of the primary element 22, respectively, and a major horizontal part 24a which spans the gap between the two vertical parts 24b.

In a sample of the antenna of FIG. 8 each of the two primary elements 20, 22 was 420 mm in horizontal length L and 10 mm in vertical length H, and the vertical part 26a of the secondary element 26 was 90 mm long. The supplementary element 38 was 150 mm long. Otherwise, the dimensions of the antenna elements and the window glass were the same as in the sample of the antenna of FIG. 7. By the test described hereinbefore, average gains (vs. the dipole antenna) of this sample antenna were −17.0 dB in the FM radio band, −19.6 dB in the VHF TV band and −18.2 dB in the UHF TV band.

Figure 9:
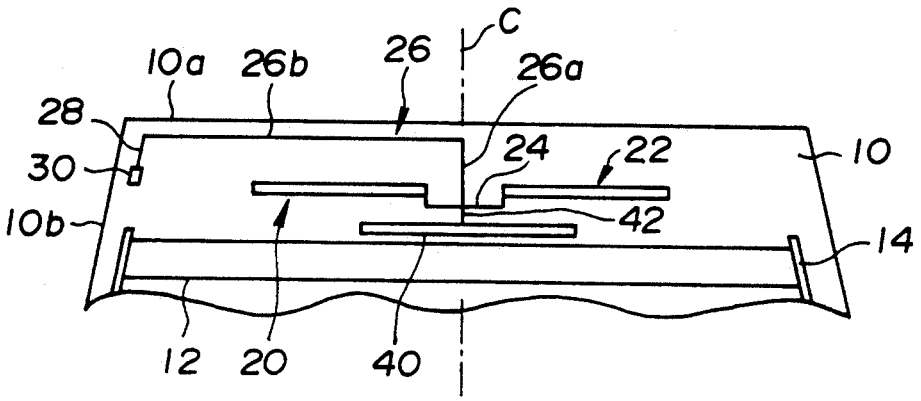

In FIG. 9, the antenna of FIG. 8 is modified by omitting the supplementary element 38 and, instead, adding a supplementary element 40 which makes the perimeter of a horizontally elongate rectangle. The supplementary element 40 is located below the primary elements 20, 22 and the connection line 24 so as to be bisected by the center axis C of the window glass. A short connection line 42 which seems to be a downward extension of the vertical part 26a of the secondary element 26, connects the supplementary element 40 to the connection line 24 and the secondary element 26.

In a sample of the antenna of FIG. 9, the vertical part 26a of the secondary element 26 was 80 mm long, and the supplementary element 40 was 300 mm in horizontal length, 10 mm in vertical length and at a vertical distance of 20 mm from the horizontal part 24a of the connection line 24. Otherwise, the dimensions of the antenna elements and the window glass were the same as the sample of the antenna of FIG. 8. By the test described hereinbefore, average gains (vs. the dipole antenna) of this sample antenna were −16.5 dB in the FM radio band, −18.8 dB in the VHF TV band and −17.2 dB in the UHF TV band.

Figure 10:
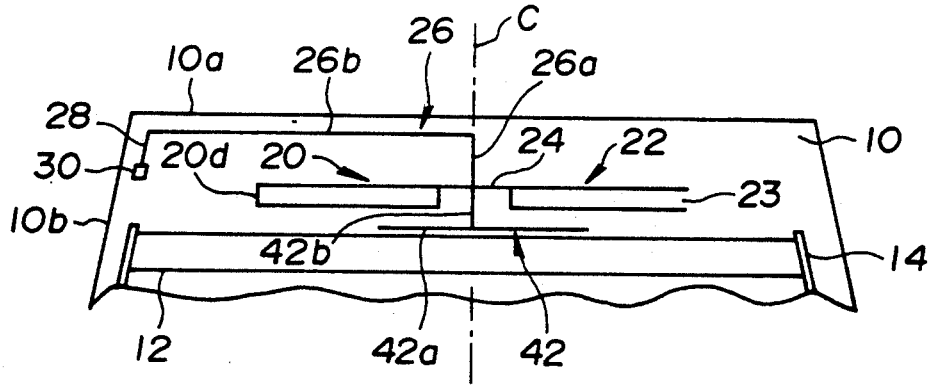

FIG. 10 shows a combination of a primary element 20 which is in the shape of the perimeter of a complete rectangle and another primary element 22 which is in the shape of an incomplete rectangle devoid of one side (23). That is, compared with the antenna of FIG. 1, only the primary element 20 on the right-hand side is modified into a rectangular shape by the addition of a vertical part 20d. Besides, the antenna of FIG. 10 includes a supplementary element 42. This element 42 is an inverted T-shaped element having a horizontal part 42a which extends below the primary elements 20, 22 and a vertical part 42b which extends upward from the middle point of the horizontal part 42a to the middle point of the connection line 24.

In a sample of the antenna of FIG. 9 the supplementary element 42 was 300 mm in the length of the horizontal part 42a and 50 mm in the length of the vertical part 42b. Otherwise, the dimensions of the antenna elements and the window glass were the same as in the sample of the antenna of FIG. 1. By the test described hereinbefore, average gains (vs. the dipole antenna) of this sample antenna were −18.2 dB in the FM radio band, −18.6 dB in the VHF TV band and −16.9 dB in the UHF TV band.

As represented by the foregoing embodiments, each of the two primary elements 20 and 22 of an antenna according to the invention is in the shape of a horizontally elongate rectangle or a horizontally elongate and incomplete rectangle devoid of one vertical side, and it is possible to choose any of the three kinds of combinations, viz. combination of two rectangles, combination of two incomplete rectangles and combination of one rectangle and one incomplete rectangle. The choice is made according to the type of the vehicle to which the antenna is to be provided and the frequency range of broadcast waves to be received most frequently. In any case it is suitable to determine the horizontal length L of each primary element 20, 22 within the range from 200 to 800 mm, and preferably in the range from 300 to 700 mm, and the vertical length H of each primary element within the range from 5 to 60 mm and preferably in the range from 10 to 40 mm. As to the horizontal distance between the two primary elements 20 and 22, i.e. horizontal length D of the connection line 24 which is not necessarily a straight line as can be seen in FIGS. 8 and 9, it is suitable that the distance or length D falls in the range from 10 to 200 mm and preferably in the range from 40 to 150 mm.

As to the secondary element 26, it is suitable that the vertical part 26a has a length of 20–100 mm, and preferably 30–90 mm, and is not more than 100 mm in the horizontal distance from the center axis C of the window glass 10. Usually a suitable length of the horizontal part 26b is 400–800 mm.

Figure 11:
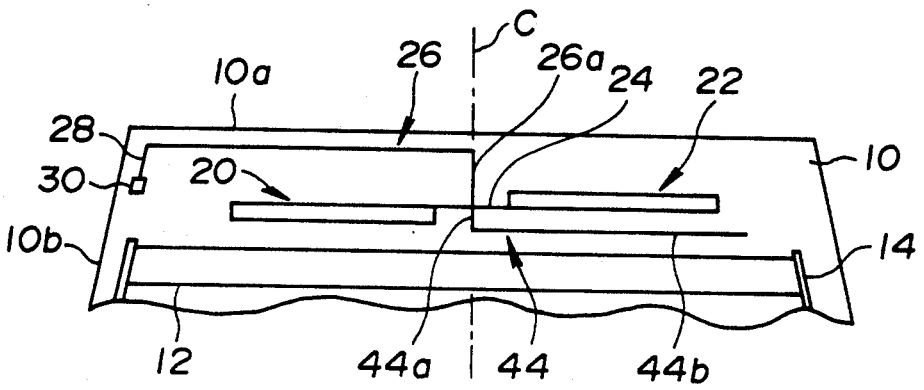

In FIG. 11, the antenna of FIG. 7 is modified in respect of the arrangement of the two rectangular primary elements 20 and 22, and an L-shaped supplementary element 44 is added. In this case the upper horizontal part 20a of the primary element 20 on the left-hand side is in alignment with the lower horizontal part 22b of the primary element 22 on the right-hand side. The supplementary element 44 has a vertical part 44a which extends downward from the middle point of the connection line 24 and a horizontal part 44b which extends parallel to the primary element 22 on the right-hand side.

Figure 12:
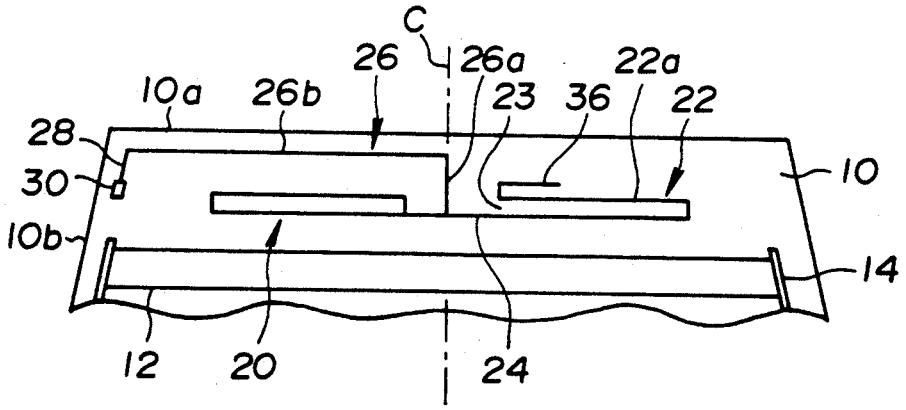

FIG. 12 shows a combination of a primary element 20 which is in the shape of the perimeter of a complete rectangle and another primary element which is in the shape of an incomplete rectangle devoid of one side (23). As a minor difference from the antenna of FIG. 10, the primary element 22 in FIG. 12 has a gap or open side 23 at the left end near the center axis C of the window glass. Besides, a supplementary element 36 is connected to the left end of the upper horizontal part 22a of the primary element 22. This supplementary element 36 has substantially the same shape as the element 36 in FIG. 5.

Both the antenna of FIG. 11 and the antenna of FIG. 12 proved to be nearly equivalent to the antenna of FIG. 1 with respect to reception gains for FM radio broadcast waves and TV broadcast waves in the VHF and UHF bands.

Figure 13:
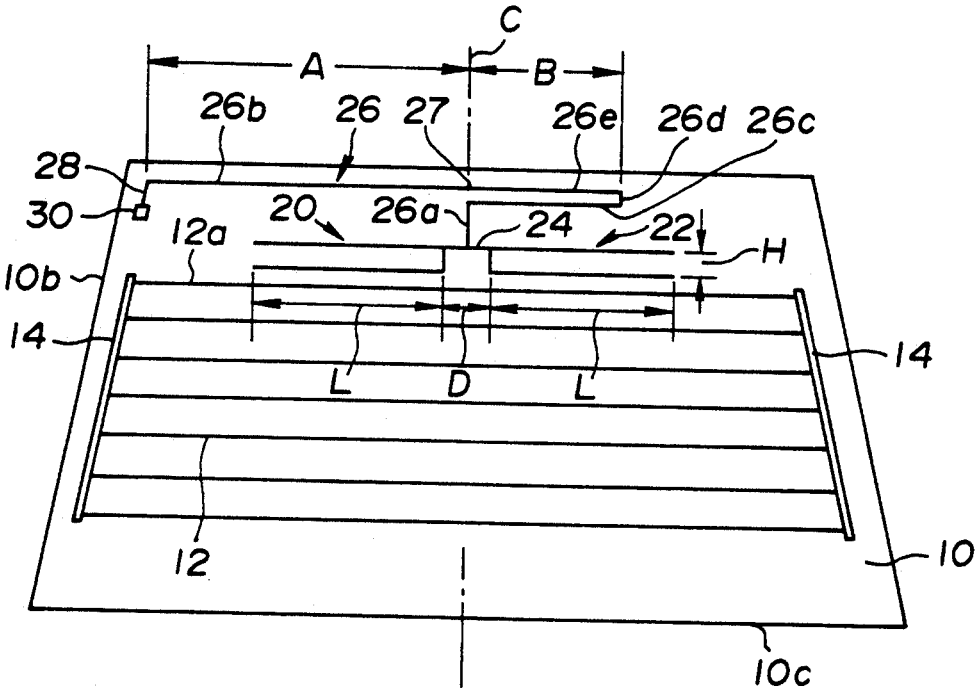
FIG. 13 shows a modification of the antenna in FIG. 1 with respect to the secondary element of the antenna.

FIG. 13 shows a modification of the antenna of FIG. 1 with respect to the shape of the secondary element 26. In the secondary element 26 in FIG. 13 the vertical part 26a does not directly connect with the horizontal part 26b, and another horizontal part 26c extends from the upper end of the vertical part 26a in the direction opposite to the feed point 30. The horizontal part 26c is not so long as the horizontal part 26b, and a short vertical part 26d extends upward from the end of the horizontal part 26c. The horizontal part 26b is extended from the original terminal point 27 so as to have an additional segment 26e which has a length equal to the length of the horizontal part 26c and reaches the upper end of the short vertical part 26d. In other words, the secondary element 26 has a horizontal part (26b+26e), a turn-back part (26d+26c) and a vertical part 26a.

In a sample of the window glass of FIG. 13 the glass plate 10 was 1180 mm in the length of the upper edge 10a, 1410 mm in the length of the lower edge 10c and 720 mm in the length perpendicular to the upper and lower edges 10a, 10c, and the dimensions of and relating to the antenna elements were as follows.

Each of the two primary elements 20, 22 was 300 mm in horizontal length L and 30 mm in vertical length H, and the lower part 20b, 22b of each element was at a vertical distance of 30 mm from the uppermost heater strip 12a. The length D of the horizontal connection line 24 was 100 mm. The secondary element 26 was 40 mm in the length of the vertical part 26a, 20 mm in the length of the short vertical part 26d, 250 mm in the horizontal length B, 560 mm in the horizontal length A and 20 mm in the vertical distance of the horizontal part 26b from the upper edge 10a of the glass.

By the test described hereinbefore average gains (vs. the dipole antenna) of this sample antenna were −15.2 dB in the FM radio band, −17.9 dB in the VHF TV band and −16.8 dB in the UHF TV band. That is, in any of the tested bands the antenna of FIG. 13 was higher in reception gain than the antenna of FIG. 1.

Figure 14:
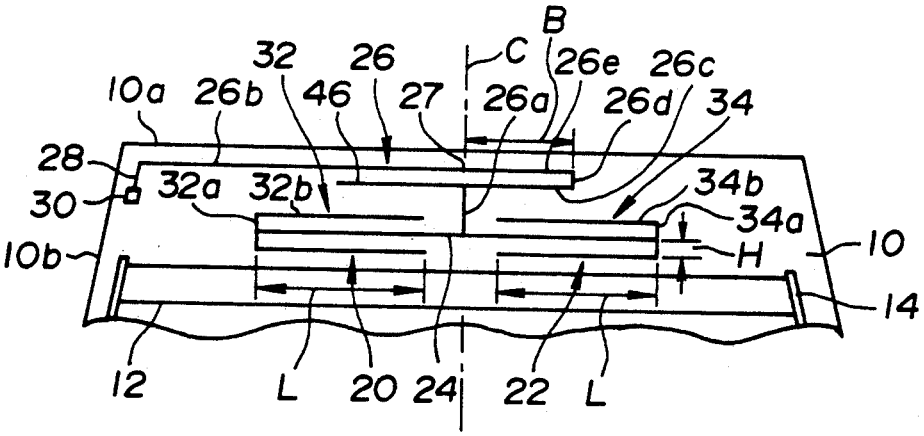
FIGS. 14 to 20 respectively show further modifications of the antenna in FIG. 13.

FIG. 14 shows a modification of the antenna of FIG. 4, which includes two supplementary elements 32 and 34, by varying the shape of the secondary element 26 in the same manner as in FIG. 13 and adding another supplementary element 46 which extends horizontally from the upper end of the vertical part 26a of the secondary element 26 toward the feed point 30.

In a sample of the antenna of FIG. 14, the horizontal length B of the secondary element 26 was 200 mm, the supplementary element 46 was 150 mm long, the vertical length H of the primary elements 20, 22 was 20 mm, and each of the supplementary elements 32 and 34 was 350 mm in the horizontal length and 20 mm in the length of the vertical part 32a, 34a. Otherwise, the dimensions of the antenna elements and the window glass were the same as in the sample of the antenna of FIG. 13. By the test described hereinbefore, average gains (vs. the dipole antenna) of the sample antenna were −16.6 dB in the FM radio band, −18.1 dB in the VHF TV band and −16.3 dB in the UHF TV band.

Figure 15:
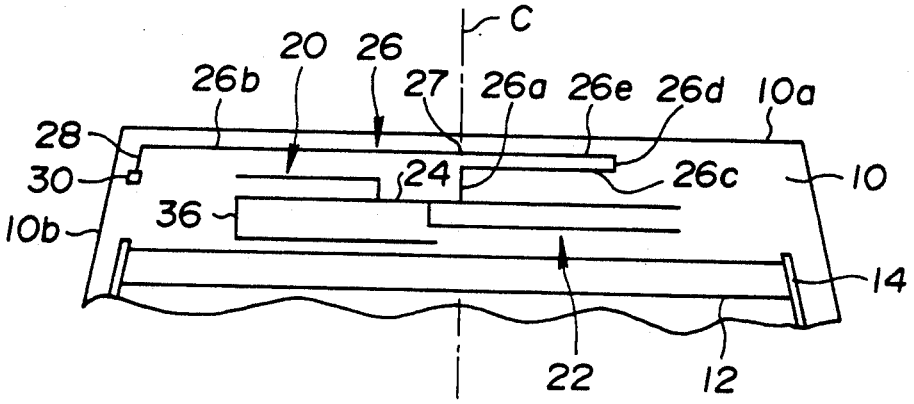

In FIG. 15 the two primary elements 20 and 22 are substantially similar to the counterparts in FIG. 2, and the secondary element 26 is substantially similar to the counterpart in FIG. 13. The antenna of FIG. 15 includes a supplementary element 36 which is connected to the primary element 20 and substantially similar to the element 36 in FIG. 6.

Figure 16:
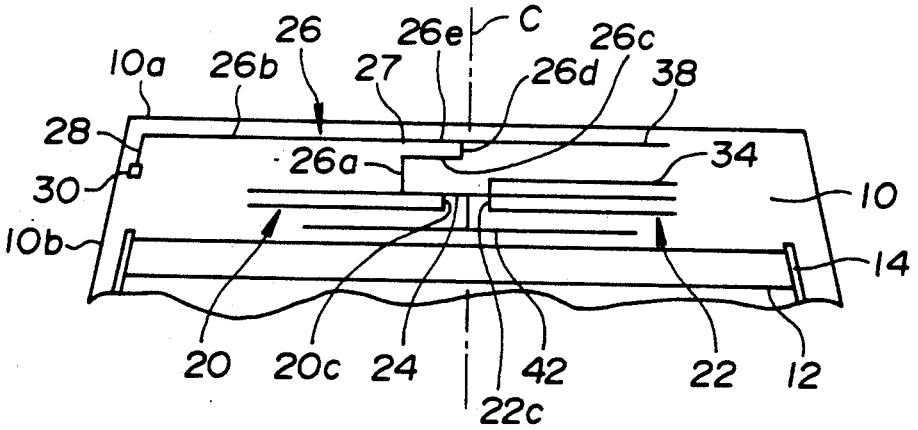

In FIG. 16 the two primary elements 20 and 22 are substantially similar to the counterparts in FIG. 13 though the vertical part 20c, 22c of each element is shortened. The secondary element 26 is modified by shifting the position of the vertical part 26a from the center axis C of the window glass toward the feed point 30 and shortening the horizontal parts 26c and 26e. The antenna of FIG. 16 includes a supplementary element 38, which extends horizontally from the upper end of the short vertical part 26d of the secondary element 26 in the direction reverse to the horizontal part 26b, and another supplementary element 42 which is arranged in the same manner as the element 42 in FIG. 10 and connected to the horizontal connection line 24.

Both the antenna of FIG. 15 and the antenna of FIG. 16 proved to be nearly equivalent to the antenna of FIG. 13 in respect of reception gains for FM radio broadcast waves and TV broadcast waves in the VHF and UHF bands.

Figure 17:
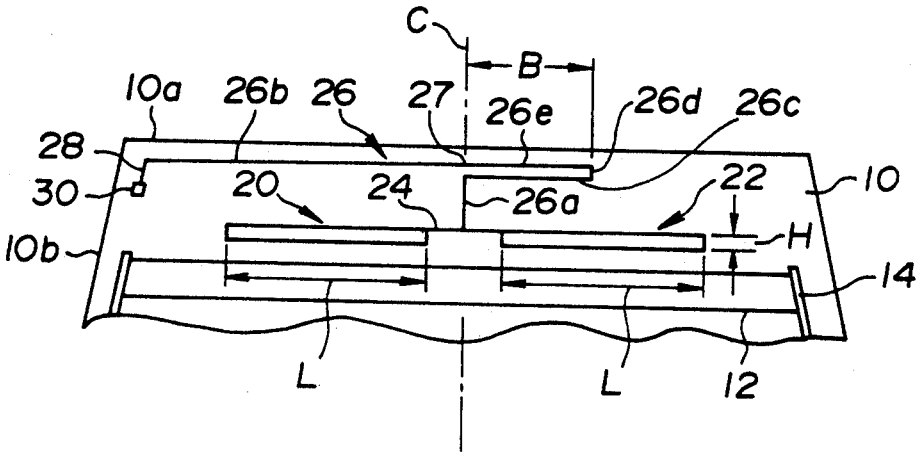

In FIG. 17 the two primary elements 20 and 22 of the antenna are arranged substantially in the same manner as in FIG. 7, and the secondary element 26 is substantially similar to the counterpart in FIG. 13.

In a sample of the antenna of FIG. 17 each of the two primary elements 20, 22 was 350 mm in horizontal length L and 20 mm in vertical length H. The secondary element 26 was 40 mm in the length of the vertical part 26a, 10 mm in the length of the short vertical part 26d and 200 mm in the horizontal length B. Otherwise, the dimensions of the antenna elements and the window glass were the same as in the sample of the antenna of FIG. 13. By the test described hereinbefore average gains (vs. the dipole antenna) of this sample antenna were −15.1 dB in the FM radio band, −18.2 dB in the VHF TV band and −16.8 dB in the UHF TV band.

Figure 18:
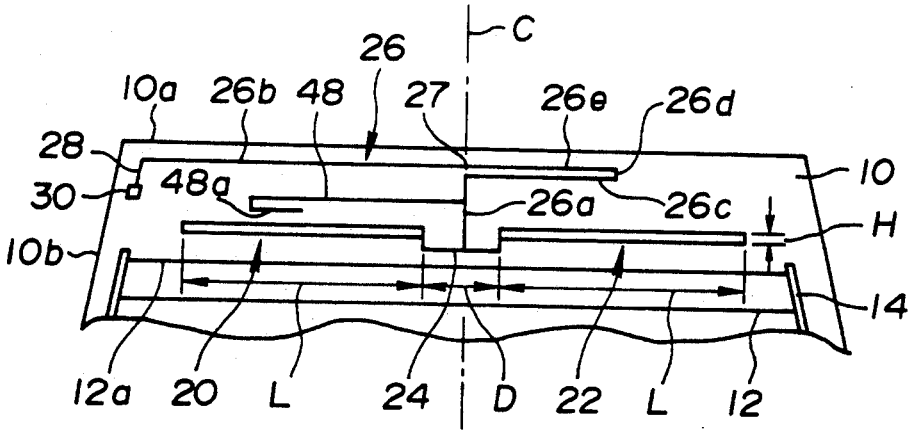

In FIG. 18 the two primary elements 20, 22 and the connection line 24 are substantially similar to the counterparts in FIG. 8, and the secondary element 26 is substantially similar to the counterpart in FIG. 13. The antenna of FIG. 18 includes a supplementary element 48, which extends horizontally from the vertical part 26a of the secondary element 26 toward the feed point 30 and bends in the left end portion so as to have a turn-back part 48a.

In a sample of the antenna of FIG. 18 each of the two primary elements 20, 22 was 420 mm in horizontal length L and 10 mm in vertical length H. The connection line 24 was 100 mm in the horizontal length D and 20 mm in the vertical distance from the uppermost heater strip 12a. The secondary element 26 was 90 mm in the length of the vertical part 26a. The supplementary element 48 was 400 mm in horizontal length. Otherwise, the dimensions of the antenna elements and the window glass were the same as in the sample of the antenna of FIG. 17. By the test described hereinbefore average gains (vs. the dipole antenna) of the sample antenna were −15.8 dB in the FM radio band, −17.9 dB in the VHF TV band and −16.4 dB in the UHF TV band.

Figure 19:
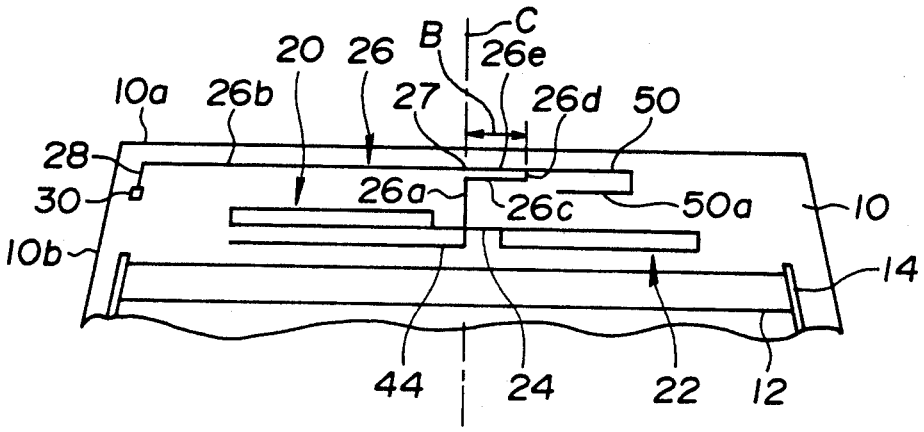

In FIG. 19 the arrangement of the two primary elements 20 and 22 resembles that in FIG. 11, but in this case the element 20 on the left-hand side is shifted upward and the element 22 on the right-hand side downward. The antenna of FIG. 19 includes an L-shaped supplementary element 44 which corresponds to the element 44 in FIG. 11 but horizontally extends in the reverse direction. The secondary element 26 is substantially similar to that in FIG. 13, but the additional horizontal length B is shortened. This antenna includes another supplementary element 50, which extends horizontally from the upper right end of the secondary element 26 in the direction reverse to the secondary element 26 and bends so as to have a turn-back part 50a.

Figure 20:
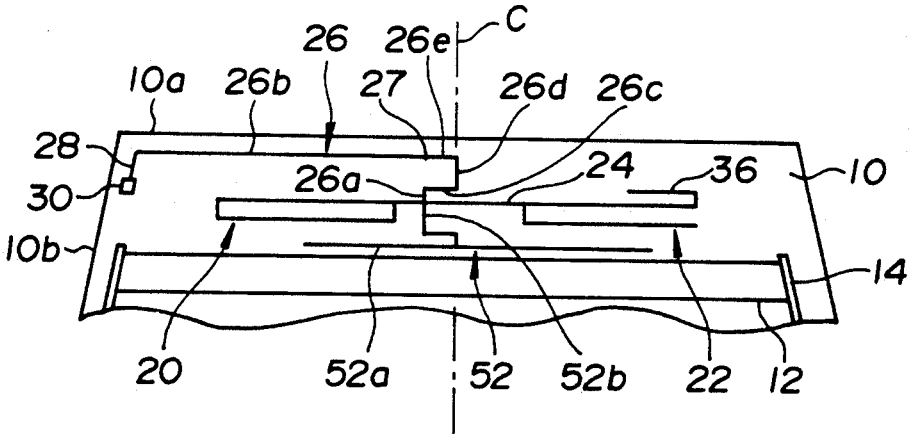

In FIG. 20 the arrangement of the two primary elements 20, 22 is similar to that in FIG. 10, and the shape of the secondary element 26 is substantially similar to that in FIG. 16. The antenna of FIG. 20 includes a supplementary element 36, which is connected to the primary element 22 in the shape of an incomplete rectangle and corresponds to the element 36 in FIG. 12, and another supplementary element which resembles the inverted T-shaped element 42 in FIG. 16. However, between the horizontal part 52*a* of the supplementary element 52 and the connection line 24 the leg part 52*b* of this element 52 is bent at right angles.

Both the antenna of FIG. 19 and the antenna of FIG. 20 proved to be nearly equivalent to the antenna of FIG. 13 in respect of the efficiencies of receiving FM radio broadcast waves and TV broadcast waves in the VHF and UHF bands.

When the secondary element 26 is shaped in the manner as shown in FIGS. 13–20 it is suitable that the additional horizontal length B of the element 26 is in the range from 30 to 350 mm, and preferably in the range from 50 to 250 mm, and it is suitable that the length of the short vertical part 26*d* is in the range from 5 to 60 mm, and preferably in the range from 10 to 50 mm.

A window glass antenna according to the invention is fully practicable by itself. However, it is optional, and rather preferable in some cases, to construct a diversity antenna system for the reception of FM radio broadcasting and TV broadcasting by combining an antenna according to the invention with another window glass antenna, which may be provided to the vehicle rear window by utilizing the space below the heater strips or another window of the vehicle, or a conventional antenna such as a pole antenna.

What is claimed is:

1. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and comprising:

a combination of two primary elements, one of the two primary elements being located on one side of a vertical center axis of the window glass, and at least a major portion of the other being located on the opposite side of said center axis, each of which is a linear element bent so as to make at least three sides of a horizontally elongate rectangle and is spaced from the other in the direction widthwise of the window glass, said three sides including two opposite horizontal sides, and a connection line which comprises a horizontal part and connects said two primary elements to each other, wherein each of said two primary elements has two parallel horizontal parts and one vertical part and makes said three sides of a horizontally elongate rectangle, and said one vertical part connects with each of said two parallel horizontal parts at an end closest said vertical center axis of said window glass;

a secondary element which is a linear element bent so as to have a first part which extends from a selected horizontal part of said combination to a point between said combination and the upper edge of the window glass, the horizontal distance of said first part of the secondary element from said vertical center axis of the window glass being not greater than 100 mm, and a second part which extends horizontally from said point toward a side edge of the window glass, at least a lower end part of said first part being a vertical part extending toward said point; and a feed point located in a marginal region of said space contiguous to said side edge of the window glass, said second part of said secondary element being connected to said feed point.

2. An antenna according to claim 1, wherein said other of said two primary elements is entirely located on said opposite side of said vertical center axis of the window glass.

3. An antenna according to claim 1, wherein the upper horizontal side of said rectangle of one of said two primary elements is horizontally in alignment with the upper horizontal side of said rectangle of the other primary element.

4. An antenna according to claim 1, wherein the upper horizontal side of said rectangle of one of said two primary elements is horizontally in alignment with the lower horizontal side of said rectangle of the other primary element.

5. An antenna according to claim 1, wherein said connection line is entirely horizontal.

6. An antenna according to claim 2, wherein said connection line is bent so as to have a horizontal middle part and two substantially vertical end parts which are connected to said two primary elements, respectively.

7. An antenna according to claim 1, wherein each of said two primary elements is 200 to 800 mm in horizontal length and 5 to 60 mm in vertical length.

8. An antenna according to claim 7, wherein said horizontal length is 300 to 700 mm.

9. An antenna according to claim 7, wherein said vertical length is 10 to 40 mm.

10. An antenna according to claim 7, wherein the horizontal distance between said two primary elements is 10 to 200 mm.

11. An antenna according to claim 10, wherein said horizontal distance is 40 to 150 mm.

12. An antenna according to claim 1, wherein said first part of said secondary element is entirely a straight and vertical part which is approximately on said vertical center axis of the window glass.

13. An antenna according to claim 12, wherein said first part of said secondary element extends upward from said connection line.

14. An antenna according to claim 12, wherein said first part of said secondary element extends upward from the upper horizontal side of said rectangle of one of said two primary elements.

15. An antenna according to claim 12, wherein said second part of said secondary element is 400 to 800 mm in horizontal length.

16. An antenna according to claim 15, wherein said first part of said secondary element is 20 to 100 mm in vertical length.

17. An antenna according to claim 1, wherein said first part of said secondary element is bent so as to have a first vertical segment which is approximately on said vertical center axis of the window glass and extends upward from said selected part of said combination, a first horizontal segment which extends from the end of said first vertical segment toward the opposite side edge of the window glass, a second vertical segment which extends upward from the end of said first horizontal segment and a second horizontal segment which extends from the end of said second vertical segment to said point.

18. An antenna according to claim 17, wherein said selected horizontal part of said combination is said connection line.

19. An antenna according to claim 17, wherein said selected horizontal part of said combination is the upper horizontal side of said rectangle of one of said two primary elements.

20. An antenna according to claim 17, wherein the total length of said first and second vertical segments is 20 to 100 mm.

21. An antenna according to claim 20, wherein said second vertical segment is shorter than said first vertical element and has a length of 5 to 60 mm.

22. An antenna according to claim 20, wherein said second segment has a length of 30 to 350 mm.

23. An antenna according to claim 17, wherein said second part of said secondary element is 400 to 800 mm in horizontal length.

24. An antenna according to claim 1, further comprising a supplementary element which is a linear element and extends from one of said two primary elements.

25. An antenna according to claim 24, wherein said supplementary element is bent so as to have at least one vertical segment and at least one horizontal segment.

26. An antenna according to claim 1, further comprising a supplementary element which is a linear element and is connected to said connection line.

27. An antenna according to claim 26, wherein said supplementary element is bent so as to have at least one vertical segment and at least one horizontal segment.

28. An antenna according to claim 26, wherein said supplementary element is a generally T-shaped element having a horizontal segment between said two primary elements and the defogging heater strips.

29. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and comprising:

a combination of two primary elements, one of the two primary elements being located on one side of a vertical center axis of the window glass, and at least a major portion of the other being located on the opposite side of said center axis, each of which is a linear element bent so as to make at least three sides of a horizontally elongate rectangle and is spaced from the other in the direction widthwise of the window glass, said three sides including two opposite horizontal sides, and a connection line which comprises a horizontal part and connects said two primary elements to each other;

a secondary element which is a linear element bent so as to have a first part which extends from a selected horizontal part of said combination to a point between said combination and the upper edge of the window glass, the horizontal distance of said first part of the secondary element from said vertical center axis of the window glass being not greater than 100 mm, and a second part which extends horizontally from said point toward a side edge of the window glass, at least a lower end part of said first part being a vertical part extending toward said point; and a feed point located in a marginal region of said space contiguous to said side edge of the window glass, said second part of said secondary element being connected to said feed point;

wherein each of said two primary elements has two parallel horizontal parts and two parallel vertical parts and makes the perimeter of a horizontally elongate rectangle.

30. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and comprising:

a combination of two primary elements, one of the two primary elements being located on one side of a vertical center axis of the window glass, and at least a major portion of the other being located on the opposite side of said center axis, each of which is a linear element bent so as to make at least three sides of a horizontally elongate rectangle and is spaced from the other in the direction widthwise of the window glass, said three sides including two opposite horizontal sides, and a connection line which comprises a horizontal part and connects said two primary elements to each other;

a secondary element which is a linear element bent so as to have a first part which extends from a selected horizontal part of said combination to a point between said combination and the upper edge of the window glass, the horizontal distance of said first part of the secondary element from said vertical center axis of the window glass being not greater than 100 mm, and a second part which extends horizontally from said point toward a side edge of the window glass, at least a lower end part of said first part being a vertical part extending toward said point; and a feed point located in a marginal region of said space contiguous to said side edge of the window glass, said second part of said secondary element being connected to said feed point;

wherein one of said two primary elements has two parallel horizontal parts and two parallel vertical parts and makes the perimeter of a horizontally elongate rectangle, whereas the other primary element has two parallel horizontal parts and one vertical part and makes said three sides of a horizontally elongate rectangle.

31. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and comprising:

a combination of two primary elements, one of the two primary elements being located on one side of a vertical center axis of the window glass, and at least a major portion of the other being located on the opposite side of said center axis, each of which is a linear element bent so as to make at least three sides of a horizontally elongate rectangle and is spaced from the other in the direction widthwise of the window glass, said three sides including two opposite horizontal sides, and a connection line which comprises a horizontal part and connects said two primary elements to each other;

a secondary element which is a linear element bent so as to have a first part which extends from a selected horizontal part of said combination to a point between said combination and the upper edge of the window glass, the horizontal distance of said first part of the secondary element from said vertical center axis of the window glass being not greater than 100 mm, and a second part which extends horizontally from said point toward a side edge of the window glass, at least a lower end part of said first part being a vertical part extending toward said point; and a feed point located in a marginal region of said space contiguous to said side edge of the window glass, said second part of said secondary element being connected to said feed point, and further comprising a supplementary element which is a linear element and is connected to said connection line;

wherein said supplementary element makes the perimeter of a horizontally elongate rectangle which is located between said two primary elements and the defogging heater strips.

32. An antenna attached to a vehicle rear window glass for receiving FM radio broadcast waves and television broadcast waves, the window glass being provided with a set of defogging heater strips so as to leave a space between the heater strips and the upper edge of the window glass, the antenna being arranged in said space and comprising:

a combination of two primary elements, one of the two primary elements being located on one side of a vertical center axis of the window glass, and at least a major portion of the other being located on the opposite side of said center axis, each of which is a linear element bent so as to make at least three sides of a horizontally elongate rectangle and is spaced from the other in the direction widthwise of the window glass, said three sides including two opposite horizontal sides, and a connection line which comprises a horizontal part and connects said two primary elements to each other;

a secondary element which is a linear element bent so as to have a first part which extends from a selected horizontal part of said combination to a point between said combination and the upper edge of the window glass, the horizontal distance of said first part of the secondary element from said vertical center axis of the window glass being not greater than 100 mm, and a second part which extends horizontally from said point toward a side edge of the window glass, at least a lower end part of said first part being a vertical part extending toward said point;

a feed point located in a marginal region of said space contiguous to said side edge of the window glass, said second part of said secondary element being connected to said feed point; and a supplementary element which is a linear element and extends from said secondary element.

33. An antenna according to claim 32, wherein said supplementary element is a straight and horizontal element.

34. An antenna according to claim 32, wherein said supplementary element is bent so as to have at least one vertical segment and at least one horizontal segment.

* * * * *